United States Patent [19]

Conway

[11] 4,081,319

[45] Mar. 28, 1978

[54] CONTINUOUS PAPERMAKING PROCESS

[75] Inventor: Bernard W. Conway, Holyoke, Mass.

[73] Assignee: The Dexter Corporation, Windsor Locks, Conn.

[21] Appl. No.: 674,152

[22] Filed: Apr. 6, 1976

[51] Int. Cl.[2] ..... D21F 1/66

[52] U.S. Cl. ..... 162/168 NA; 162/178; 162/190

[58] Field of Search ..... 162/177, 178, 168 NA, 162/190

[56] References Cited

U.S. PATENT DOCUMENTS

| | | | |
|---|---|---|---|
| 3,098,786 | 7/1963 | Biles et al. | 162/157 |
| 3,245,871 | 4/1966 | Yang | 162/177 |
| 3,391,057 | 7/1968 | Spence et al. | 162/168 NA |

*Primary Examiner*—Robert L. Lindsay, Jr.
*Assistant Examiner*—William F. Smith
*Attorney, Agent, or Firm*—Prutzman, Hayes, Kalb & Chilton

[57] ABSTRACT

A continuous, essentially closed recirculating papermaking process is provided by using a dispersing medium of adjustable viscosity. The process permits the continuous reuse of the medium under preferred operating conditions. It includes the steps of forming a dispersion of fibers within the adjustable medium containing a pH sensitive viscosity producing agent, reducing the fiber consistency and the viscosity within the dispersion while maintaining the concentration of the agent substantially unchanged, subsequently forming a fibrous web material on a papermaking screen from said dispersion of reduced fiber consistency while separating the dispersing media from the fibers forming the web and continuously collecting the separated media and recirculating it within the system to effect a subsequent fiber dispersion as well as a fiber consistency reduction and viscosity reduction without substantially changing the concentration of the viscosity producing agent. The separated and recirculated dispersing media is capable of forming a high viscosity dispersing media for the fibers at the time of forming the subsequent fiber dispersion without the addition of more viscosity producing agent.

11 Claims, 2 Drawing Figures

CONTINUOUS PAPERMAKING PROCESS

BACKGROUND AND SUMMARY OF THE INVENTION

The present invention relates generally to continuous papermaking operations and is more particularly concerned with a new and improved papermaking process wherein the fiber dispersing media is fully recirculated within the system.

As is well known, in a wet papermaking process the operating conditions and characteristics required for forming an aqueous fiber dispersion differ substantially from the optimum conditions needed for forming the fibrous web material. For example, a high fiber consistency is preferred at the chest or fiber dispersing area of the system while it is generally desired to provide a very dilute fiber dispersion at the headbox or web-forming area of a papermaking machine. Similarly, a low viscosity dispersing media at the web-forming area will usually promote rapid drainage while a high viscosity dispersing media frequently is needed to prevent entanglement and achieve good dispersion of the fiber stock prior to its introduction into the headbox of a papermaking machine. Accordingly, it is generally preferred to provide conditions of high viscosity and high fiber consistency when initially dispersing the fibers and low viscosity coupled with low fiber consistency at the headbox and sheet-forming area of the papermaking machine.

As set forth in U.S. Pat. No. 3,093,534, the fiber furnish or dispersion is frequently formed at maximum viscosity, using an additive such as polyacrylic acid at a fiber consistency of up to about 6 percent by weight. The furnish is then diluted with water to a fiber consistency of about 0.1 to 1.0 percent fiber at the headbox prior to its application to the web-forming screen. The diluating operation that lowers the fiber consistency also substantially reduces the concentration of the viscosity producing agent such that the aqueous solution of the agent cannot be reused for fiber dispersing purposes without replenishing substantial quantities of the agent. Thus much of the economic advantage associated with a recirculating system is lost.

The desirability of providing a continuous recirculating system for the "white water" of a papermaking system has long been recognized and one such attempt is described in U.S. Pat. No. 3,245,871. That patent indicates that prior agents were substantive to the fibers and suggests the use of nonsubstantive water soluble hydroxyethyl cellulose and high molecular weight derivatives of glucose in place of the prior viscosity producing agents. However, even in such a system it is required that the fiber dispersion be diluted at the headbox with fresh water to achieve the requisite fiber consistency and additional quantities of viscosity producing agent must be added to compensate for the dilution.

Accordingly, it is an object of the present invention to provide a new and improved continuous recirculating papermaking system well suited for high viscosity, high fiber consistency within the fiber-dispersing area of the system and low viscosity, low fiber consistency at the web-forming area without the necessity for altering the concentration of the viscosity producing agent during the entire recirculatory process.

Another object of the present invention is to provide a recirculating papermaking process of the type described that utilizes viscosity producing agents which are responsive to readily adjustable chemical and physical changes in order to alter the viscosity of the fiber dispersing media. Included in this object is the provision for use of agents capable of altering the viscosity of the media in response to changes in the pH of the media.

Yet another object of the present invention is to provide a substantially closed recirculating papermaking system or process that exhibits the economic advantages associated with the conservation of a viscosity producing agent through the repetitive recycling thereof. Included in this object is the provision for viscosity producing agents that are sensitive to changes in pH in a repetitive and recirculatory fashion in order to adjust and control the viscosity of the material within which they are dispersed and provide optimum operating conditions at different locations within the system.

A further object of the present invention is to provide a process of the type described that utilizes aqueous solutions of polymers and gums capable of altering the viscosity of aqueous dispersing media in response to reversible changes in the pH of those solutions.

Other objects will be in part obvious and in part pointed out more in detail hereinafter.

These and related objects are accomplished in accordance with the present invention by providing a continuous, essentially closed recirculating papermaking process that includes the steps of forming a dispersion of fibers within a medium containing a viscosity producing agent, reducing the fiber consistency and the viscosity within the dispersion while maintaining the concentration of the agent substantially unchanged, subsequently forming a fibrous web material on a papermaking screen from said dispersion of reduced fiber consistency while separating the dispersing medium from the fibers forming the web and continuously collecting the separated medium and recirculating it within the system to effect both the formation of a subsequent fiber dispersion and a reduction in the fiber consistency and viscosity of a subsequent fiber dispersion without substantially changing the concentration of the viscosity producing agent, said separated and recirculated dispersing medium being adapted at the time of forming the subsequent fiber dispersion of forming a high viscosity dispersing medium for the fibers.

A better understanding of the invention will be obtained from the following detailed description of the several steps and the relationship of one or more steps with respect to each of the others as well as the features and properties exemplified in the following detailed description.

DESCRIPTION OF THE PREFERRED EMBODIMENT

Figure 1:
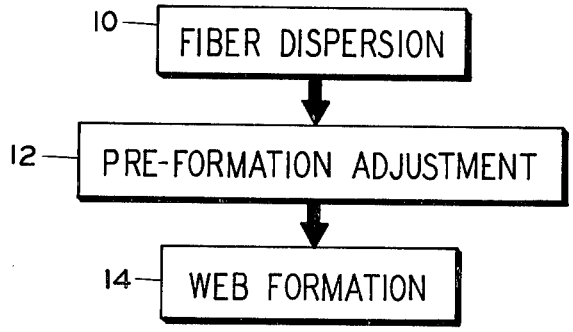
FIG. 1 is a flow diagram for a typical wet papermaking system.

As indicated in FIG. 1, the wet end of a papermaking system generally involves at least three system areas: (1) the fiber dispersion area 10 where the fibers are uniformly dispersed within a fluid medium, such as water or the like, to form the requisite fiber stock, dispersion or furnish; (2) a stock adjustment area 12, such as the headbox of a papermaking machine, where the fiber consistency is controlled prior to web formation to assure optimum web-forming conditions within the dispersion; and (3) a sheet or web-forming area 14 where the fibers are separated from the dispersing medium in the form of a fibrous web or mat, typically by depositing the fibers on a wire screen, such as a Fourdrinier wire.

Figure 2:
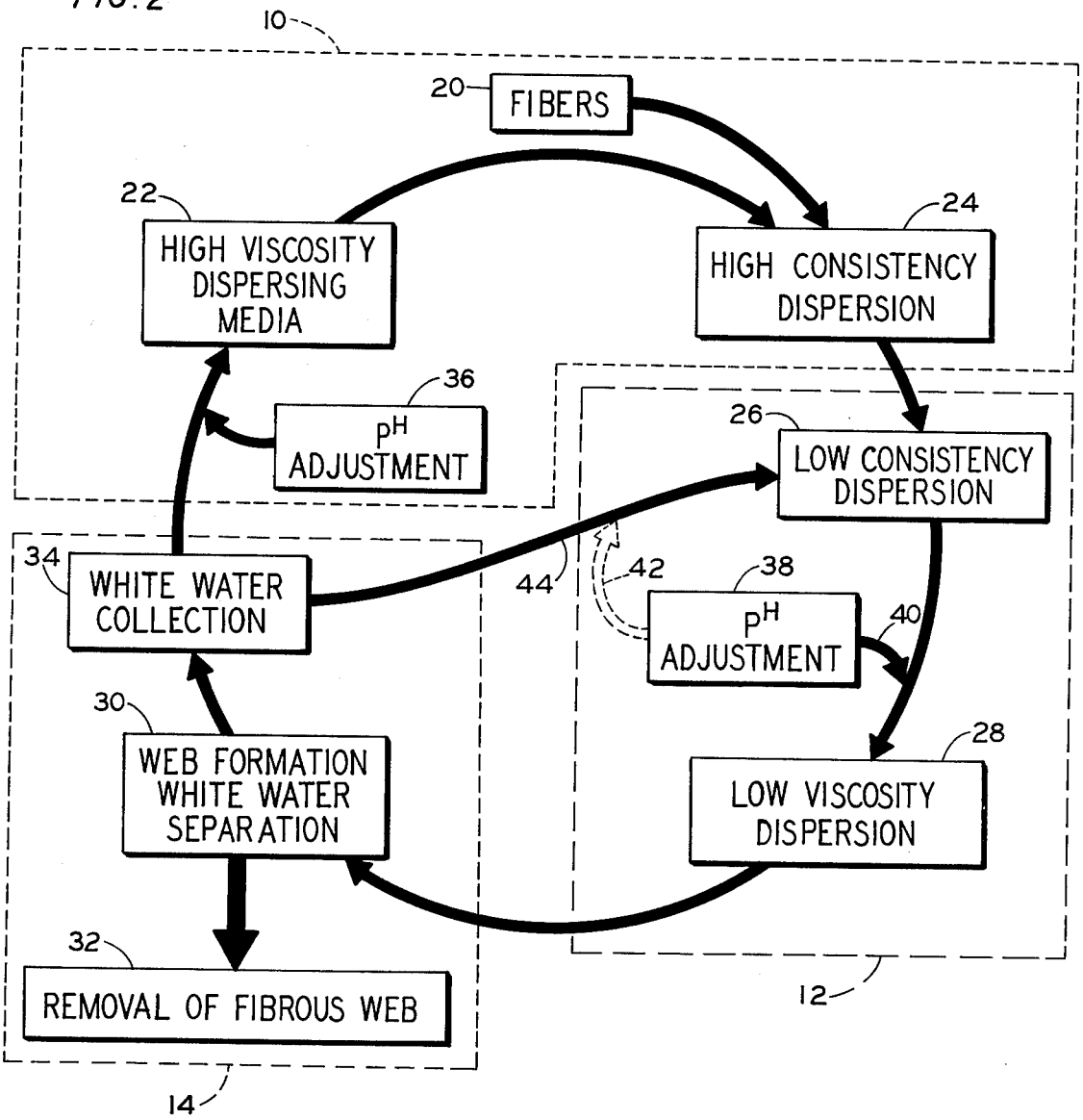
FIG. 2 is a schematic and diagrammatic flow chart of a closed recirculating system in accordance with the present invention.

In accordance with the present invention the closed recirculating system ideally provides a mechanism not only whereby fibers may be introduced at one end of the system and removed from the opposite end as a continuous sheet or web of fibrous nonwoven material but also whereby the dispersing medium is continuously reused within the system without substantial replenishment of the major components thereof. In the ideal situation all components of the system with the exception of the fibers are recirculated with little or no additions to the system except for minor controls and adjustments. Such a system is illustrated in FIG. 2 of the drawing wherein fibers, indicated by the numeral 20, are initially dispersed within a high viscosity dispersing medium 22 to provide a dispersion of high fiber consistency 24. As will be appreciated, the greatest economies of operation are achieved under the optimum dispersing conditions wherein the fiber consistency is the highest possible for the fibers employed. The resultant fiber furnish 24 is fed to the adjustment station 12 of a papermaking system where it is diluted to reduce the fiber consistency, as indicated at 26, and treated to adjust and usually lower the viscosity of the dispersing medium. The dilute low viscosity fiber furnish 28 then is fed to the forming wire of a papermaking machine where the fibrous web material is formed and separated from the dispersing medium, commonly referred to as the "white water". The formation and separation operation 30 yields a fibrous web that is subsequently removed from the forming wire as indicated by the numeral 32, and passed on to dryers or treating sections depending on the characteristics required for the resultant product. The separated white water 34 is collected for recirculation within the system. In accordance with the present invention the collected white water provides a dual function, that is, it provides the diluting medium for the adjustment station 12 and also provides the dispersing medium 22 for the initial formation of the fiber dispersion or furnish 10, all within a closed system and without the need for replenishment.

As will be appreciated, the collected white water 34 is at the reduced viscosity required for web formation at the wire of the papermaking machine and consequently must be adjusted in order to provide the high viscosity condition required for dispersing the fibers. In accordance with the present invention the controlled viscosity conditions are achieved primarily by adjustment in the pH of the white water as it is fed to the fiber furnish formation station 10. The recirculation of the white water and controlled adjustment of its viscosity, as by the pH adjustment 36, is accomplished without the necessity for the addition of further amounts of viscosity producing agent since the agent is initially selected as a material which will be retained within the white water and which will exhibit the reversible or recyclable viscosity characteristics required of the system through a simple adjustment in a physical or chemical character, such as an adjustment in the pH of the solution containing the agent.

As will be appreciated, the present system permits the utilization of a wide variety of fibers in the formation of the resultant fibrous web material. Thus the fibers may be of natural or man-made materials or combinations thereof. For example, natural fibers of bleached or unbleached kraft, manila hemp or jute may be used. Synthetic and man-made fibers, such as rayon, nylon, polyester, vinyl copolymeric material or the like, also may be used with good results. The high viscosity in the chest or fiber dispersion station 10 will permit the utilization of numerous fibers and mixtures of fibers that are longer than those wood fibers normally characterized as fibers of papermaking length. These would include mixtures of textile fibers, such as textile staple fibers either alone or in combination with the substantially shorter conventional papermaking fibers. The high viscosity dispersing medium serves to prevent the formation of fiber clumps in the fiber dispersion and reduces the tendency of such fibers to interentangle.

As will be appreciated, the fibers are generally subjected to the conventional or standard papermaking operations prior to introduction into the initial high viscosity fiber furnish. For example, standard papermaking operations, such as chemical digesting and refining of natural fibers may be required to properly condition the fibers for their use within the system or in order to achieve a specific end result. Regardless of the techniques employed it is generally desirable that good fiber separation be achieved at the fiber dispersing station 10 and for this purpose a fiber dispersing medium of high viscosity is generally preferred. Additionally, the fiber concentration or consistency within the dispersion is generally high in order to avoid the use of inordinately large storage vessels or chests prior to use of the material at the web-forming papermaking machine.

The dispersing medium 22 is generally an aqueous solution of a viscosity producing agent used at a concentration that will permit adjustment in the solution's viscosity by a simple adjustment in its pH. At the fiber dispersing station 10 the viscosity of the medium 22 is preferably at a level in excess of about 10 centipoise and usually the solution has a viscosity of about 50 to 100 centipoise. As will be appreciated, the viscosity actually utilized will vary depending on the type, concentration and characteristics of the fibers employed but can, for practical applications, be as high as about 900 centipoise or higher. The system of the present invention has the advantage of permitting the use of a very high viscosity dispersing media since the system envisions a reduction in the viscosity of the dispersion prior to the web-forming operation. Thus, the extremely high viscosities do not create a situation which might interfere with the drainage characteristics of the system or provide an undesirable reduction in the speed of operation when producing the fibrous web material on a commercial basis. As will be appreciated, other conventional papermaking considerations will also dictate the specific viscosities utilized so as to provide optimum runability of the papermaking machine.

The viscosity producing agent may be natural or synthetic materials or blends or combinations thereof. For example, the agents may be natural gums which are pH sensitive and will, at certain concentrations, exhibit the ability to recycle their viscous characteristics in response to changes in the pH of the aqueous gum solution. One such agent is quince seed gum which can vary in initial viscosity from about 1300 cps at a concentration of 0.5 percent by weight to a viscosity of 15 cps at a concentration of 0.05 percent and exhibits a recyclable viscosity that varies with pH. For example, an aqueous solution at 0.1 percent can be adjusted between a viscosity of 125 cps at a pH of 3.5 and a viscosity of 25 cps at a pH of 3.7. Additionally, the gums may be of a type which exhibit the desirable recycling property only when combined with other materials. An example of these are the gums which combine with borax to act as structural gels (viscous colloidal solutions) due to the cross-linking of the borate ion with the hydrated gum structure. Examples of these are locut bean gum and guar gum derivatives. A surprising feature of these materials is their nonrecyclability when used alone. For example a 0.2 percent solution of locut bean gum will exhibit an unchanged viscosity about 12–15 cps at pH levels ranging from 3 to 10 but when combined with 25 percent borax based on the weight of the gum will exhibit a recyclable viscosity between about 1200 cps at a pH of 9.0 and 15 cps at a pH of 6.0. Similarly a 0.2 percent solution of a guar gum derivative (Gendriv 162 sold by General Mills Co.) will exhibit a constant viscosity of 20 cps over a pH range of 4.2 to 10.0 but when 25 percent borax is added will exhibit a viscosity of 2200 cps at a pH of 8 and a viscosity of 20 at a pH of 5.

In addition to the natural viscosity producing agents, it is possible in accordance with the present invention to utilize synthetic material, such as high molecular weight resins, pH sensitive surfactants and the like, to control the viscosity of the dispersing medium. As will be appreciated, the synthetic material should preferably be water soluble and exhibit the recycling characteristics mentioned hereinbefore with respect to the natural gums. The preferred materials of this type are the polyacrylamide polymers which can be used in dilute aqueous solutions at low concentration levels to provide the requisite pH sensitive viscosity required in accordance with the system of the present invention. The preferred polyacrylamide resins employed are the materials sold by Dow Chemical Company under the trade name Separan AP-30 and by American Cynamid Company under the trade name Cytame 5. Table I sets forth the pH effect on viscosity of typical Separan solutions at different concentration levels.

Table I

| 0.2% | | 0.1% | | 0.05% | | 0.025% | |
|---|---|---|---|---|---|---|---|
| pH | Viscosity (cps) | pH | Viscosity (cps) | pH | Viscosity (cps) | pH | Viscosity (cps) |
| 9.4 | 90 | 9.2 | 35 | 8.7 | 20 | 8.5 | 10 |
| 3.2 | 10 | 3.0 | 7 | 3.0 | 5 | 3.0 | 2 |
| 8.7 | 60 | 8.9 | 25 | 9.0 | 15 | 9.0 | 10 |
| 3.4 | 10 | 3.1 | 8 | 3.4 | 5 | 3.2 | 2 |
| 9.0 | 65 | 9.7 | 25 | 8.7 | 15 | 9.2 | 10 |
| 3.0 | 8 | 3.0 | 8 | 3.3 | 4 | 3.3 | 3 |

As will be noted, for this material the viscosity of the initially prepared solution is slightly higher than the recycled level thus indicating the slight effect of the acid and base used to provide the pH variations. However, the dilution is minimal since only about 6 to 7 cc of 3 percent hydrochloric acid needed to be added to 500 cc at 0.05 percent solution in order to adjust the pH from about 8 to about 3.5 while about 6 cc of 3 percent sodium hydroxide solution was needed to recycle the pH back to a level of about 8. In addition, other materials, such as surfactants, that produce a controlled viscosity in aqueous solutions may be used so long as they are compatible with the papermaking process, that is, are stable to shear forces within the system, and exhibit the requisite recycling capability. As will be appreciated, the specific concentration of the agent within the solution may vary depending on the specific material utilized. Additionally, the recycling properties of the individual agents may vary at different concentrations such that optimum conditions may result from different amounts of particular agents.

The fiber consistency within the initial fiber dispersion is relatively high, i.e. on the order of about 1 to 7 percent. In other words, the fiber suspension contains at least about 1 lb. of fiber for each 15 to 100 lbs. of high viscosity dispersing medium. In some instances, the consistency may be as high as 8 or 9 percent but the preferred range is between about 0.5 and 5 percent by weight. The fibers in this high consistency dispersion are well separated and, due to the high viscosity of the solution, are free from interentanglement or snarls.

As mentioned hereinbefore, the high consistency dispersion is diluted, preferably with a portion of the white water collected from the system, to effect the desired low consistency without altering the concentration of the viscosity producing agent. This dilution may take place by a series of diluting operations or in a single step as the material passes from a storage container toward the forming wire of the papermaking machine. The dilution is typically tenfold or more such that the fiber consistency after dilution is below 1 percent. Thus the low consistency dispersion may fall within the conventional papermaking consistency of 0.1 – 0.5 percent or less. Where highly dilute suspensions are used, the consistency after dilution may be as low as about 0.001 percent although consistencies on the order of 0.02 – 0.05 are conventionally used.

In accordance with the present invention the initial fiber dispersion is not only diluted to provide a lower fiber consistency but is also treated, either simultaneously or subsequently but in any event prior to web formation, in such a manner as to decrease the viscosity of the fiber dispersion without changing the concentration of the viscosity producing agent. In accordance with the preferred embodiment of the present invention this is achieved by a pH adjustment, as indicated by the numeral 38. A partial adjustment of the pH will, of course, be accomplished during the dilution of the fiber stock with the white water previously collected within the system. However, the primary pH adjustment is accomplished through either the direct addition of an acid or base to the fiber dispersion as indicated by the solid line 40 or, optionally, by adjustment of the white water pH just before or during the diluting operation that lowers the fiber consistency, as indicated by the broken line 42. The specific increase or decrease in the pH of the fiber dispersion will be dictated by the particular viscosity producing agent employed and the adjustment can range through a span of as many as 6 or 8 pH units or as few as 0.1 to 0.3 pH units. While the larger change in pH may be desirable in order to assure proper and more accurate pH control and while the small pH variation might be desirable from an economic and concentration control standpoint, it is generally preferred that a change in viscosity results from an intermediate pH variation. In this connection the viscosity producing agent used is generally of greater significance and the pH variation for an individual agent will control. The resultant viscosity may be as low as 1.5 cps or as high as about 50 cps but is usually less than one half of the high viscosity level with the range of 10 cps to 30 cps giving consistently good results.

As will be appreciated, the adjustment of both viscosity and fiber concentration is fully achieved without altering the concentration of the viscosity producing agent. Thus, this concentration can remain consistent throughout the entire repetitive cycle of the system and thereby obviate the need for introducing additional quantities of the agent to the system. It will, of course, be appreciated that some operating losses will be experienced and the additions of acid and base will cause slight concentration variations such that some additions of materials will be required in order to compensate for these slight variations.

The resultant low viscosity, low consistency fiber dispersion 28 is next directed to the web formation section 30 of a papermaking machine such as a Fourdrinier wire where the fibrous web material is formed and the dispersing medium is separated from the fibers in a conventional manner and collected for recirculation within the system. As mentioned, the collected white water 34 which exhibits the same concentration of viscosity producing agent as the fiber dispersion can then be used in a dual manner within the system. As indicated by the line 44, it can be used for reducing the fiber consistency, and to a lesser degree the viscosity, of the initial fiber dispersion 24. However, a substantial remaining quantity thereof can undergo an additional pH adjustment, as indicated by the numeral 36 to once again increase in viscosity to the desired level for use in forming an initial fiber dispersion 24. This will result in completion of the closed cycle of the system such that fibers 20 added at one end of the system are removed as fibrous web material 32 at the opposite end with the white water fully recirculated within the system. More importantly this is achieved while maintaining optimum fiber dispersing conditions at the fiber dispersing station 10 and optimum web-forming conditions at the web formation and white water separation station 14.

In order that the present invention may be more readily understood, it will be further described with reference to the following specific examples which are given by way of illustration only and are not intended to be a limit on the practice of the invention.

EXAMPLE I

This example illustrates the continuous recirculating papermaking system of the present invention.

An initial fiber slurry was prepared by adding 5 grams of cut rayon tow to 500 ml. of a 0.057 percent aqueous solution of a polyacrylamide (Separan AP-30) having a pH of 7.2 and a viscosity of 40 cps. The rayon fibers were of ½ inch length and a denier of 1.5 dpf. The resultant 1 percent fiber suspension was mixed using a bench top agitator to form a well dispersed slurry free of tangled fibers.

Ten handsheets were made from this slurry using a Buchner funnel fitted with a six-inch diameter Fourdrinier wire as the web forming element. This was accomplished by placing a 50 ml. aliquot of the 1 percent fiber slurry in a mixing vessel with 950 ml. of an aqueous Separan solution having the same viscosity and pH as the slurry thereby reducing the fiber consistency to 0.05 percent. The low consistency fiber disperson was thoroughly mixed by pouring the stock from one beaker to another about ten times. During this mixing operation, 1.2 ml. of 10 percent sulfuric acid was added to the dispersion resulting in a reduction in pH to 4.5 and a reduction in viscosity to 9.5 cps. The slurry was poured into the Buchner funnel where a web was formed, the drainage time using gravity flow being 19.6 seconds. The white water was collected and saved.

A second 50 ml. aliquot of the 1 percent fiber slurry was mixed with 950 ml. of the white water saved from the preceding handsheet operation. The resultant 0.05 percent consistency dispersion exhibited a pH of 4.7 and a viscosity of 9.3. A handsheet was formed within the Buchner funnel requiring a drain time under gravity flow of 18.7 seconds.

Eight additional handsheets were produced in the same way by repeatedly reusing the white water from the preceding handsheet to dilute each 50 ml. aliquot of the 1 percent fiber slurry. A few drops of 10 percent sulfuric acid was added to the dilute dispersion when making the fourth, sixth and eighth sheets in order to adjustably control the pH. The basis weight, dispersion pH and viscosity, and the drainage time for each of the ten handsheets is listed in the following table:

TABLE II

| Sheet No. | Basis Wgt. gm/m² | Slurry pH | Dispersant Viscosity cps | Drainage Time Sec. |
|---|---|---|---|---|
| 1 | 32.2 | 4.5 | 9.5 | 18.6 |
| 2 | 31.0 | 4.7 | 9.3 | 18.7 |
| 3 | 32.2 | 4.8 | 11.5 | 18.8 |
| 4 | 33.4 | 4.7 | 9.2 | 18.0 |
| 5 | 32.2 | 4.9 | 11.5 | 17.1 |
| 6 | 30.5 | 4.8 | 10.0 | 18.6 |
| 7 | 32.7 | 5.0 | 11.5 | 19.1 |
| 8 | 26.8 | 4.8 | 9.5 | 18.3 |
| 9 | 25.6 | 4.9 | 10.8 | 17.4 |
| 10 | 29.3 | 5.0 | 11.0 | 17.4 |

The white water from the ten handsheets exhibited a pH of 5.0 and a viscosity of 11 cps. Five hundred milliliters of the white water from the tenth handsheet was treated with 0.25 ml. of 10 percent sodium hydroxide resulting in a solution pH of 8.3 and a viscosity of 27 cps. To this solution was added 5 grams of cut rayon tow (one-half inch length, 1.5 dpf) and the slurry was mixed using a bench top agitator thereby forming a second 1 percent fiber slurry.

A 50 ml. aliquot of the second 1 percent fiber slurry was mixed with 950 ml. of white water from the tenth handsheet resulting in a fiber consistency of 0.05 percent. The pH of the dilute dispersion was adjusted to 4.6 by the addition of 0.2 ml. of 10 percent sulfuric acid resulting in a viscosity of 9.6 cps. An eleventh handsheet was formed in the Buchner funnel and exhibited a drainage time of 15.2 seconds. The white water was saved and used as the diluting media for producing a twelfth sheet from another 50 ml. aliquot of the second 1 percent fiber slurry. The basis weight and dispersion pH and viscosity for sheets eleven and twelve are recorded below:

| Sheet No. | Basis Wgt gm/m² | Slurry pH | Dispersant Viscosity cps | Drainage Time Sec. |
|---|---|---|---|---|
| 11 | 33.4 | 4.6 | 9.6 | 15.2 |
| 12 | 33.4 | 4.7 | 9.5 | 16.1 |

All 12 handsheets made by this continuously recirculating process exhibited uniform fiber dispersion free from fiber entanglement and all webs were of a quality well suited for use in nonwoven applications.

EXAMPLE II

This example illustrates the improved drainage time achieved when forming a fibrous web from a dispersion exhibiting low viscosity rather than high viscosity.

About 908 grams of 1⅛ inch 1.5 dpf rayon fibers previously treated with a dispersing agent were added to 30 gallons of an aqueous solution of a polyacrylamide (Separan AP-30) having a viscosity of 100 cps and a pH of 9.7. The fiber dispersion is agitated for about 10 minutes so that the 0.8 percent fiber consistency dispersion is free of any tangled fibers and the fibers therein are well dispersed.

About 220 ml. of this stock solution is diluted with 8580 ml. of an identical fiber-free Separan solution having a viscosity of 100 cps and a pH of 9.7. The resultant dispersion, having a fiber consistency of 0.02 percent, is cascaded 20 times to fully blend the stock and the dispersion is then poured into the headbox of a handsheet mold and a web formed therefrom. The drainage time for the web formation was 23 seconds.

The second 220 ml. portion of the 0.8 percent fiber stock dispersion is similarly diluted with 8580 ml. of a Separan solution having a viscosity of 100 cps and a pH of 9.7. In this instance the 0.02 percent fiber consistency dispersion is treated with 12 ml. of 10 percent sulfuric acid resulting in a dispersion viscosity of 12 cps and a dispersion pH of 4.0. The dispersion is then fed to the headbox of a handsheet mold and a web is formed. However, in this instance, the drainage time for the low viscosity dispersion is only 9 seconds. In both instances the resultant web materials were of suitable quality for nonwoven web applications.

CONTROL EXAMPLE

This example illustrates the poor results achieved when high fiber consistencies are dispersed in a low viscosity medium.

About 30 gallons of a 100 cps Separan solution having a pH of 7.3 was prepared in an appropriate container in the manner indicated in Example II and the pH and viscosity adjusted by adding sulfuric acid until the pH was 4.2 and the viscosity was 12 cps. To this aqueous media was added 908 grams of 1⅛ inch 1.5 dpf rayon fibers that had been previously treated with a dispersing aid. The 0.8 percent fiber consistency slurry was agitated in the manner of the preceding example. However, the fibers within the slurry became entangled and did not disperse well.

A 220 ml. aliquot of the low viscosity dispersion was diluted with 8580 ml. of a Separan solution having a pH of 4.2 and a viscosity of 12 cps resulting in a fiber consistency of 0.02 percent. The slurry was cascaded 20 times and a web was formed therefrom. A drainage time of 9 seconds was noted. However, the web quality was very poor and was unsuited for use as a nonwoven product due to the presence of entangled fiber clumps.

EXAMPLE III

This example illustrates the raising and lowering of the viscosity of the dispersing medium prior to dispersing the fibers therein and the ultimate formation of a web material.

About 50 gallons of a Separan solution was prepared having a pH of 7.3. The solution was treated with 15 ml. of concentrated ammonium hydroxide to raise the pH to 8.4, resulting in a viscosity of 103 cps. The high viscosity solution was then treated with 365 ml. of concentrated sulfuric acid to effect lowering of the pH to 4.2. This resulted in a solution viscosity of 12 cps. The low viscosity solution was then treated with 60 ml. of concentrated ammonium hydroxide resulting in a solution having a pH value of 9.8 and a viscosity of 60 cps. This cycled solution was then used for the subsequent operations.

About 908 grams of 1⅛inch 1.5 dpf rayon fibers were added to 30 gallons of the cycled solution described above and agitated for 10 minutes to provide a 0.8 percent fiber consistency. The dispersion exhibited no entanglement and the quality of the dispersion was visually as good as the dispersion obtained in Example II.

A 220 ml. aliquot of the dispersion was diluted with 8580 ml. of the recycled solution to provide a dispersion having a fiber consistency of 0.02 percent. The dilute dispersion was cascaded 20 times and 18 ml. of 10 percent sulfuric acid was slowly added to the dispersion to reduce the pH to 4.5 and the viscosity to 11 cps. The stock was then poured into the headbox of a handsheet mold and a web was formed therefrom. The material exhibited a drainage time of 10 seconds and the resulting web was of a quality well suited for use in nonwoven applications.

EXAMPLE IV

This example illustrates the reduction in viscosity of the fiber dispersion at an intermediate stage in the reduction of the fiber consistency.

An initial fiber furnish was prepared in a laboratory beater by adding 100 grams of rayon fibers having a length of 1⅛ inches and a denier of 1.5 dpf to 20 liters of an aqueous dispersing medium having a viscosity of 85 cps. The dispersing medium was a 0.2 percent by weight solution of a polyacrylamide (Separan AP-30). The resultant furnish had a fiber consistency of 0.5 percent. After thoroughly dispersing the fibers within the dispersing medium, the solution was diluted to a fiber consistency of 0.12 percent using additional quantities of the 0.2 percent polyacrylamide solution. The pH of the solution was adjusted with hydrochloric acid to a value of about 5.0 resulting in a solution viscosity of 30 cps. After thoroughly mixing the solution by pouring it from one container to another at least ten times, it was diluted to a fiber consistency of 0.02 percent using a 0.2 percent polyacrylamide solution having a pH of 5 and a viscosity of 30 cps. A handsheet was prepared from the dispersion resulting in a product having a basis weight of about 10 pounds per ream.

The procedure described hereinbefore for preparing a handsheet was repeated except that the initial dilution of the high viscosity furnish was sufficient to provide a fiber consistency of 0.02 percent whereupon the dispersion was treated with hydrochloric acid to lower the pH to 5 and the viscosity to 30 cps. A handsheet was formed under substantially identical drainage conditions.

EXAMPLE V

The following example illustrates the use of quince seed gum as a viscosity producing agent. This gum exhibits a wide viscosity range with only a slight pH change.

A fiber furnish was prepared from a 0.1 percent quince seed gum solution by initially adjusting the solution with hydrochloric acid to a pH of 3.5 resulting in a viscosity of 90 cps. About 1.5 grams of ¾ inch, 1.5 dpf rayon staple fibers were added to the quince seed solution whereupon the solution was cascaded for 20 times before being introduced to a handsheet mold. A 5 percent sodium hydroxide solution was sprayed on the dispersion to adjust its pH to 4.3 whereupon a handsheet was formed resulting in a stiff but well formed sheet material.

EXAMPLE VI

This is an example of the use of a very high viscosity dispersing agent made from a natural gum that has been modified with borax.

An aqueous solution of a guar gum was prepared at a guar gum concentration of 0.1 percent. A borax solution was added to the gum solution so that the resultant high viscosity dispersing medium contained about 30 percent by weight of borax based on the weight of the guar gum. The pH of the solution was adjusted to 9.2 with sodium hydroxide resulting in a viscosity of 950 cps. To the dispersing medium was added 100 grams of 1⅛ inch 1.5 dpf rayon fibers at a fiber consistency of 0.5 percent. The solution was mixed and diluted with additional amounts of the gum/borax high viscosity dispersing medium to a fiber consistency of 0.12 percent. The pH of the solution was then reduced to 5.5 with hydrochloric acid to yield a viscosity of 20 cps and the fiber consistency further diluted to provide a consistency of 0.2 percent at a viscosity of 20 cps following which a handsheet was made therefrom.

The foregoing example was repeated except that the initial fiber consistency was 1.0 percent and the pH of the stock solution was 8.5.

As will be apparent to persons skilled in the art, various modifications, adaptations and variations of the aforegoing specific disclosure can be made without departing from the teachings of the present invention.

I claim:

1. A continuous, essentially closed recirculating papermaking process comprising the steps of forming a first dispersion of fibers within a dispersion medium containing a viscosity producing agent, said agent being present at a concentration level sufficient to provide an initial high viscosity of at least 3 cps for dispersing said fibers; reducing the fiber consistency within the dispersion and at least partially chemically treating the dispersion medium to reduce the viscosity of the dispersion medium while maintaining a constant concentration level of said viscosity producing agent; subsequently forming a fibrous web on a papermaking screen from said dispersion of reduced fiber consistency and reduced viscosity while separating and collecting as white water the dispersing medium passing through said screen; at least partially chemically treating a portion of the collected white water to increase the viscosity of said white water without adding additional amounts of viscosity producing agent, continuously recirculating the white water and forming a subsequent fiber dispersion therefrom of high viscosity.

2. The process of claim 1 wherein the viscosity of the dispersing medium repeatedly shifts between said high and reduced values in response to changes in the pH of the medium.

3. The process of claim 1 wherein the reduction in fiber consistency comprises the step of adding to the dispersion a diluting solution containing substantially the same concentration of said agent as the dispersing medium of high viscosity.

4. The process of claim 1 wherein the viscosity of the dispersing medium is reduced simultaneously with the reduction in fiber consistency.

5. The process of claim 1 wherein the collected white water is added to the fiber dispersion to effect said reduction in fiber consistency without changing the concentration of said viscosity producing agent.

6. A continuous, essentially closed recirculating papermaking process comprising the steps of forming an initial dispersion of fibers within a dispersing medium containing a viscosity producing agent at a concentration sufficient to provide a viscosity of at least about 3 cps, adding to the dispersion a solution containing substantially the same concentration of said agent as said dispersing medium to reduce the fiber consistency within the dispersion and at least partially chemically treating the dispersing medium to adjust the pH of the dispersion and reduce the viscosity thereof to less than one half the viscosity of said initial dispersion, subsequently forming a fibrous web from said dispersion of reduced fiber consistency and reduced viscosity while separating and collecting the dispersing medium as white water, at least partially chemically treating a first portion of said collected white water to adjust the pH thereof and increase the viscosity thereof to at least about 3 cps for use in forming a subsequent fiber dispersion and using a second portion of the collected white water to reduce the fiber consistency of said subsequent fiber dispersion, the concentration of the viscosity producing agent being maintained substantially constant without additional amounts of viscosity producing agent throughout the continuous recirculating process while forming and treating the initial and subsequent fiber dispersions.

7. The process of claim 6 wherein the viscosity producing agent is pH sensitive and is selected from the group consisting of natural gums, gum derivatives and borax and polyacrylamide resins.

8. The process of claim 6 wherein the initial dispersion of fibers has a fiber consistency of at least about 0.5 percent by weight and the reduction in fiber consistency is at least five fold.

9. The process of claim 6 wherein the pH is adjusted subsequent to a reduction in the fiber consistency.

10. The process of claim 6 wherein the fiber consistency and viscosity are reduced simultaneously.

11. The process of claim 9 wherein the reduced fiber consistency falls within the range of 0.001 – 0.5 percent by weight.

* * * * *